US005993152A

United States Patent [19]

Schilling

[11] Patent Number: 5,993,152

[45] Date of Patent: Nov. 30, 1999

[54] NONLINEAR VANE ACTUATION

[75] Inventor: Jan C. Schilling, Middletown, Ohio

[73] Assignee: General Electric Company, Cincinnati, Ohio

[21] Appl. No.: 08/950,084

[22] Filed: Oct. 14, 1997

[51] Int. Cl.[6] ..... F04D 29/46

[52] U.S. Cl. ..... 415/160; 415/155

[58] Field of Search ..... 415/154, 160, 415/161, 162, 155

[56] References Cited

U.S. PATENT DOCUMENTS

| | | | |
|---|---|---|---|
| 3,066,488 | 12/1962 | Mock | 415/159 |
| 3,314,595 | 4/1967 | Burge et al. | 415/160 |
| 3,990,809 | 11/1976 | Young et al. | 415/160 |
| 4,430,043 | 2/1984 | Knight et al. | 415/159 |

FOREIGN PATENT DOCUMENTS

| | | | |
|---|---|---|---|
| 1153404 | 3/1958 | France | 415/159 |
| 334421 | 11/1958 | Switzerland | 415/162 |

*Primary Examiner*—Edward K. Look
*Assistant Examiner*—Richard Woo
*Attorney, Agent, or Firm*—Andrew C. Hess; Nathan D. Herkamp

[57] ABSTRACT

An actuation system for variable stator vanes pivotally mounted in a casing includes a plurality of levers joined to the respective vanes. An actuation ring coaxially surrounds the casing adjacent to the levers. A plurality of circumferentially spaced apart ring guides are joined to the casing for guiding circumferential rotation of the ring. Respective slip joints are provided between each of the levers and the actuation ring for varying pivot length of the levers as the ring is rotated for effecting nonlinear vane actuation.

19 Claims, 3 Drawing Sheets

NONLINEAR VANE ACTUATION

BACKGROUND OF THE INVENTION

The present invention relates generally to gas turbine engines, and, more specifically, to variable stator vane actuation in multi-stage axial compressors thereof.

In a gas turbine engine, air is pressurized in a compressor and channeled to a combustor wherein it is mixed with fuel and ignited for generating hot combustion gases which flow downstream therefrom into one or more turbine stages which extract energy therefrom for powering the compressor and producing useful work. A typical compressor has a plurality of axial stages which compress the air in turn as it flows downstream. And, each compressor stage includes a row of rotor blades extending radially outwardly from a compressor spool or disk, and a cooperating row of stator vanes extending radially inwardly from an annular casing.

In order to control performance and stall margin of the compressor, many of the stator vane rows are variable for selectively adjusting the angle of the vanes relative to the air being compressed. Variable stator vanes include a spindle which extends radially outwardly through a casing and to which is attached a lever. The lever in turn is pivotally joined to a unison ring coaxially surrounding the compressor casing. The several unison rings for the different variable stages are in turn typically joined to a common beam pivotally joined to the casing at one end and joined to a suitable actuator at an opposite end. The actuator pivots the beam which in turn rotates the unison rings connected thereto which in turn rotates the respective levers attached thereto for pivoting the corresponding stator vanes.

Since the individual levers are pivotally joined to the unison rings, the unison rings are allowed to rotate circumferentially and translate axially to follow the path of the levers. The rotation of the unison rings directly rotates the attached levers and vanes in a substantially linear cooperation. And, the amount of stator vane pivoting varies from stage to stage since the several unison rings are joined to the common beam at correspondingly different pivoting lengths from the pivoting end of the beam.

Since a gas turbine engine typically operates over a range of output power, the operation of the compressor is correspondingly scheduled for maximizing efficiency of operation without undergoing undesirable aerodynamic stall. Vane scheduling is controlled by the kinematic motion of the levers, unison rings, and actuation beam.

However, it is desirable to introduce further variability in the stator vane position schedule for further improving engine performance and efficiency while maintaining an effective stall margin.

SUMMARY OF THE INVENTION

An actuation system for variable stator vanes pivotally mounted in a casing includes a plurality of levers joined to the respective vanes. An actuation ring coaxially surrounds the casing adjacent to the levers. A plurality of circumferentially spaced apart ring guides are joined to the casing for guiding circumferential rotation of the ring. Respective slip joints are provided between each of the levers and the actuation ring for varying pivot length of the levers as the ring is rotated for effecting nonlinear vane actuation.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
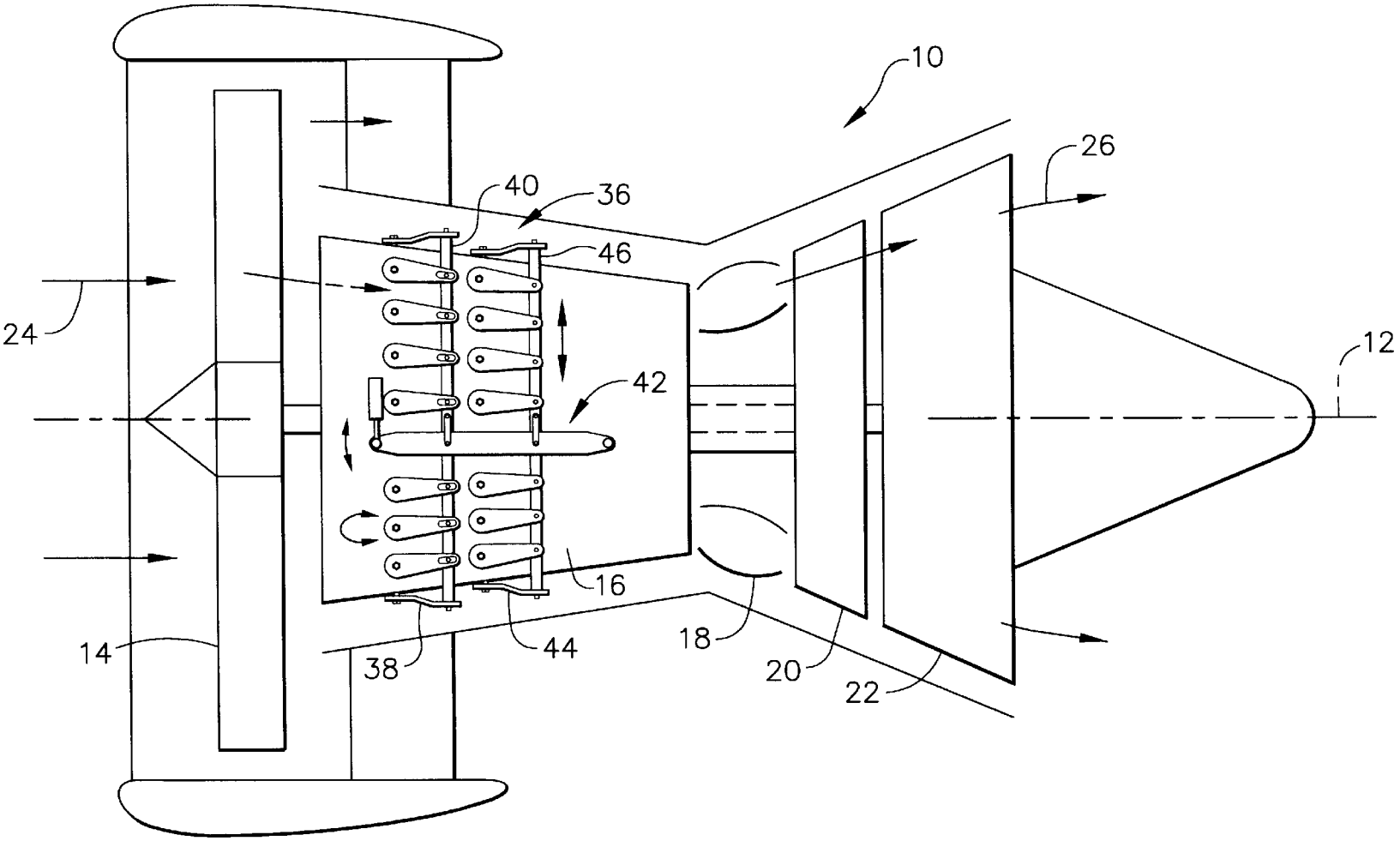
FIG. 1 is a schematic representation of an exemplary turbofan gas turbine engine including a multi-stage axial compressor having a variable stator vane actuation system in accordance with an exemplary embodiment of the present invention.

Illustrated schematically in FIG. 1 is an exemplary aircraft turbofan gas turbine engine 10 having an axial centerline axis 12. The engine 10 includes in serial flow communication a fan 14, multi-stage axial compressor 16, annular combustor 18, high pressure turbine (HPT) 20, and low pressure turbine (LPT) 22 which are axisymmetric about the centerline axis 12. Ambient air 24 flows through the fan 14 and a portion of which enters the compressor 16 wherein it is suitably pressurized and channeled to the combustor 18 wherein it is mixed with fuel and ignited for generating hot combustion gases 26 which flow downstream through the HPT 20 for powering the compressor 16 and through the LPT 22 for powering the fan 14 while producing thrust. The compressor 16 includes various stages which in turn further pressurize the air 24 therein, some of which stages are variable in accordance with the present invention.

Figure 2:
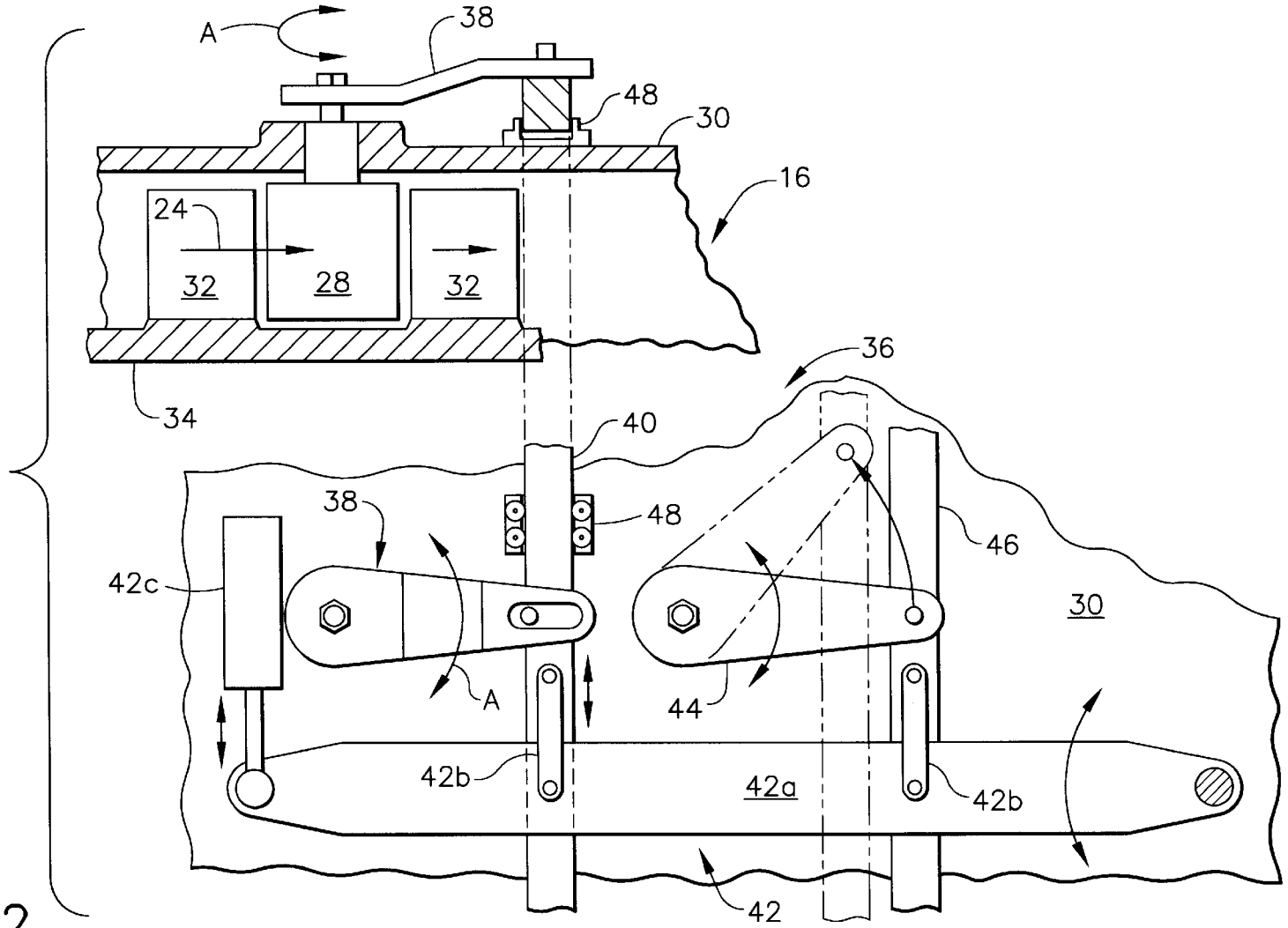
FIG. 2 is a partly sectional axial view of a portion of the compressor illustrated in FIG. 1 including the actuation system in accordance with an exemplary embodiment of the present invention.

More specifically, and referring to FIG. 2, the compressor 16 includes a plurality of variable stator vanes 28 suitably pivotally mounted in corresponding rows in an annular casing 30. The vanes 28 cooperate with corresponding compressor rotor blades 32 arranged in rows and extending radially outwardly from a corresponding compressor spool or disks 34 which in turn are joined to the HPT 20 illustrated in FIG. 1 by a suitable rotor shaft. As the air 24 flows axially downstream from vane 28 to blade 32 in each of the several axial stages, it is further increased in pressure.

In order to maximize efficiency of the compressor 16 and maintain a suitable stall margin, the vanes 28 in one or more of the stages are preferably selectively pivotable over a scheduled range of pivot angles A to correspondingly vary the orientation of the individual vanes 28 relative to the flow of air 24.

In accordance with the present invention, an improved actuation system 36 is provided for pivoting the vanes 28 in at least one of the stages for obtaining a nonlinear pivoting schedule relative to other stages having a substantially linear schedule. As shown in FIG. 2, a plurality of first levers 38 are fixedly joined to respective spindles of the stator vanes 28 in one stage for rotating the vanes when desired. Each of the levers 38 in the exemplary stage illustrated are joined to a first actuation or unison ring 40 which coaxially surrounds the casing 30 axially adjacent to the levers 38.

Suitable means 42 are provided for rotating the ring 40 to in turn rotate the levers 38 to pivot the vanes 28 in accordance with a predetermined position schedule for maximizing compressor efficiency with a suitable amount of stall margin. The rotating means 42 may take any conventional form, and in the exemplary embodiment illustrated in FIG. 2 includes a central beam 42*a* extending axially along the casing 30 and having a proximal end pivotally joined to the casing 30. A cross link 42*b* extends circumferentially between the ring 40 and the beam 42*a* and is pivotally joined thereto at its opposite ends. A suitable actuator 42*c*, which may be hydraulic, pneumatic, or electric, is operatively joined to a distal end of the beam 42*a* to selectively rotate the beam 42*a* about its proximal end to in turn rotate the ring 40 through the link 42*b*.

Another stage of the vanes may be conventionally scheduled or varied using conventional second levers 44 which are fixedly joined at proximal ends to the vane spindles, and also pivotally joined at their opposite distal ends to a conventional second actuation or unison ring 46.

The second ring 46 is similarly joined to the common beam 42*a* by another one of the links 42*b*. In the exemplary embodiment illustrated in FIG. 2, the second ring 46 is located between the first ring 40 and the pivot point of the beam 42*a*. During operation, the actuator 42*c* translates the distal end of the beam 42*a* causing the beam to pivot around its proximal end. In turn, the links 42*b* cause the respective actuation rings 40, 46 to rotate circumferentially around the casing 30 to in turn rotate the respective levers 38, 44 which in turn rotates the respective compressor vanes 28 joined thereto. Since the second ring 46 is joined to the beam 42*a* closer to its pivot point than the first ring 40, the range of rotation of the second levers 44 is typically less than the range of rotation of the first levers 38.

Furthermore, the actuation system for the second levers 44 is conventional, with the distal ends of the second levers 44 being pivotally mounted to the second ring 46. This, therefore, requires that the second ring 46 is axially unrestrained so that as the second levers 44 rotate, the second ring 46 is allowed to freely translate axially to follow the path of the second levers 44 as shown in phantom in FIG. 2. In this way, substantially linear correspondence between the movement or rotation of the second ring 46, and rotation of the second levers 44 and attached compressor vanes is obtained.

Figure 3:
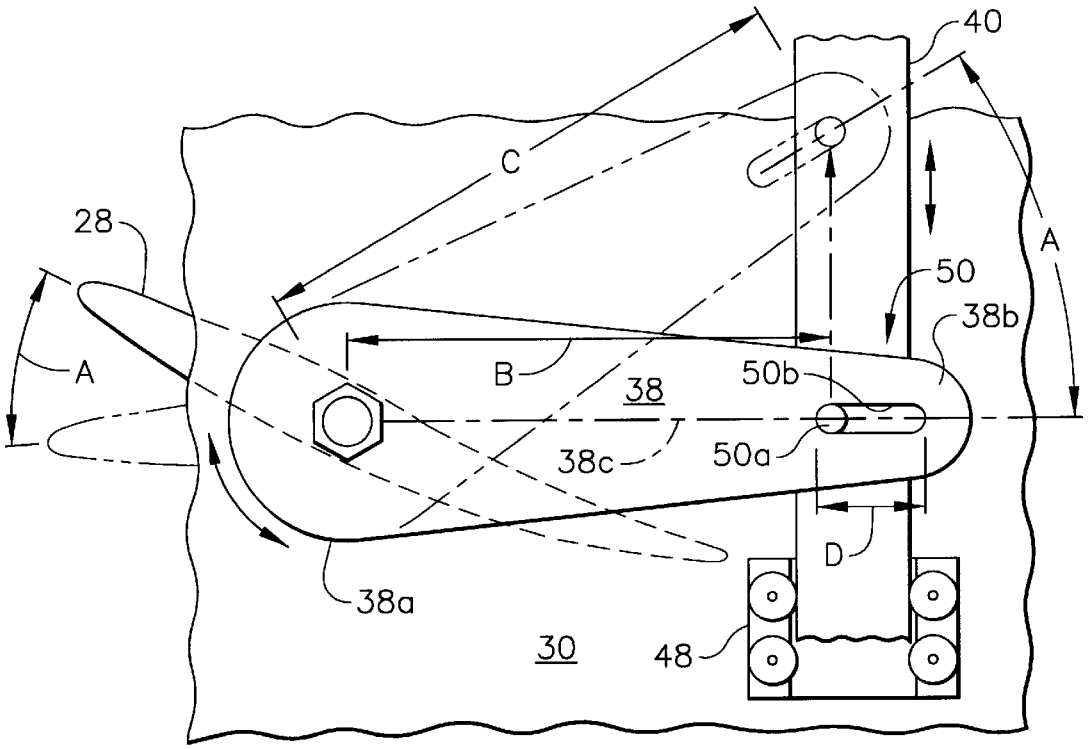
FIG. 3 is an enlarged, top view of one of the stator vane levers illustrated in FIG. 2 joined to a corresponding actuation ring for effecting nonlinear actuation in accordance with the invention.

In accordance with the present invention, it is desired to provide nonlinear scheduling between the first ring 40 and corresponding levers 38 to provide additional variability in performance of the compressor 16 at selected stages as compared to the conventional linear scheduling of other stages such as that actuated by the second ring 46. FIG. 3 illustrates in more particularity a portion of the actuation system 36 suitably modified for effecting nonlinear scheduling of the compressor vanes 28 in response to rotation of the first ring 40.

Each lever 38 includes a proximal end 38*a* which is removably fixedly joined to a respective one of the compressor vanes 28 in any conventional manner. For example, each vane 28 includes a spindle extending radially outwardly through the casing 30 which passes through a corresponding hole in the lever 38 to which it is attached by a suitable retaining nut. Each lever 38 also includes an opposite distal end 38*b*, and a centerline lever axis 38*c* extending therebetween. By moving or turning the lever 38, the attached vane 28 pivots over a range of pivot angles A which are conventionally determined for maximizing aerodynamic efficiency of the compressor with suitable stall margin.

A plurality of circumferentially spaced apart ring guides 48 are fixedly joined to the casing 30 for guiding circumferential movement or rotation of the first ring 40. Means in the form of slip joints 50 are provided for joining each of the lever distal ends 38*b* to the ring 40 for varying pivot length B of the levers 38 as the ring 40 is rotated by the beam 42*b*.

FIG. 3 illustrates in solid line a first position of the lever 38 having a minimum pivot length B, and in phantom line the lever 38 is disposed in a second position wherein the pivot length is maximum and is designated C. In the exemplary embodiment illustrated in FIG. 3, the ring guides 48 are joined to the casing 30 on opposite axial sides of the ring 40 to restrain or limit axial movement thereof while permitting primarily only circumferential rotation. The ring guides 48 may include suitable rollers on opposite sides of the ring 40 which allow relatively low friction rotation of the ring 40 while preventing axial movement thereof.

Whereas the conventional second ring 46 illustrated in FIG. 2 is allowed to translate axially for following movement of the second levers 44, the first ring 40 illustrated in FIG. 3 is prevented from moving axially relative to the first levers 38 so that the pivot length may vary for introducing nonlinear response of the first levers 38 and attached vanes 28 relative to the movement or rotation of the first ring 40.

In the exemplary embodiment illustrated in FIG. 3, each of the slip joints 50 includes a pin 50*a* engaging an elongate slot 50*b* disposed between the lever distal end 38*b* and the ring 40. In this way, the levers 38 and ring 40 are joined together to effect the variable pivot length B, C as the ring 40 rotates the lever 38.

In one configuration, the pin 50*a* may be fixedly joined to the outer surface of the ring 40, and extends radially outwardly. Correspondingly, the slot 50*b* is disposed in the lever distal end 38*b* to slidingly engage the pin 50*a* extending radially therethrough as the ring 40 rotates to vary the position of the lever 38. The slot 50*b* has a suitable length D which allows the pin 50*a* to translate between opposite ends of the slot 50*b* over the intended maximum range of rotation of the levers 38. Since the ring 40 is axially constrained by the ring guides 48, the pin 50*a* remains in the same axial plane even as the ring 40 is rotated. Since the lever 38 rotates relative to the vane spindle at its proximal end 38*a*, the slot 50*b* prevents binding between the levers 38 and the ring 40 and allows the levers 38 to be turned over their full intended pivoting range, with the pin 50*a* sliding along the length of the slot 50*b*.

The slip joint 50 may be otherwise effected by instead mounting the pin to the individual levers 38 and providing suitable slots in the ring 40 itself if desired. Alternatively, the lever distal ends 38*b* may be mounted in respective end slots in the ring 40 for effecting the slip joints and allowing variable pivot length. Yet further, the ring guides 48 may be alternately configured to permit controlled axial movement of the ring 40 as it rotates to introduce further nonlinearity in the vane schedule (not shown).

In the exemplary embodiment illustrated in FIG. 3, the lever axis 38*c* extends longitudinally between the proximal and distal ends 38*a*,b thereof and also extends through the centers of the mounting spindle and pin 50*a* thereat. Rotation of the lever axis 38*c* therefore directly corresponds with the pivoting angle A as the lever 38 is rotated about its proximal end. Accordingly, the range of the pivoting angle A of the lever 38 through the lever axis 38*c* is equal to the corresponding pivoting angle A with the vane 28 attached thereto. In this embodiment, each of the slots 50*b* is disposed in the lever distal ends 38*b* at least in part along the lever axis 38*c* for allowing the pins 50*a* to move or slide in their respective slots 50*b* along the lever axis 38*c*.

In the exemplary embodiment illustrated in FIG. 3, the slots 50*b* are straight and aligned coaxially with respective ones of the lever axes 38*c*.

Figure 4:
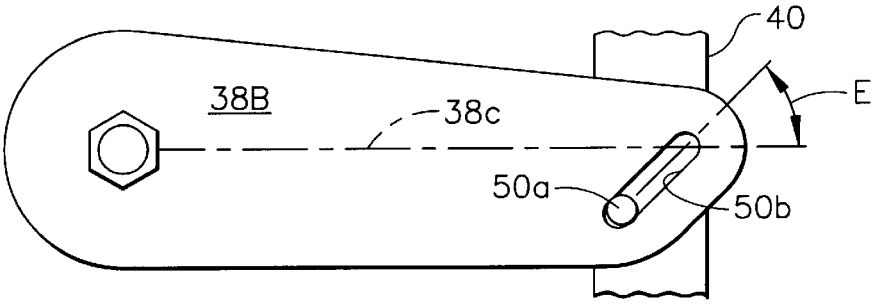
FIG. 4 is a top view of a stator vane lever in accordance with an alternate embodiment of the present invention.

In an alternate embodiment illustrated in FIG. 4, the lever, designated 38B, has a slot 50*b* which is straight but skewed circumferentially relative to the lever axis 38*c* at a skew angle E of about 45°. In this way additional nonlinearity may be introduced as desired. The skew angle E may be positive as shown, or negative for oppositely skewing the slot 50*b*. In yet another alternate embodiment (not shown), the individual slots 50*b* may be curved or arcuate for additionally affecting the nonlinearity in the vane schedule.

The improved actuation system 36 disclosed above uses basically conventional components for their simplicity and proven effectiveness, with suitable modifications in accordance with the present invention to introduce varying degrees of nonlinearity in scheduling the compressor vanes 28. The actual vane scheduling is determined for each engine application and desired engine cycle for maximizing compressor efficiency with suitable stall margin. The nonlinearity provided in this schedule by the improved cooperation between the levers 38 and unison ring 40 allows additional optimization and tailoring of the vane schedule as desired.

Furthermore, one or more of the variable stator vane stages may be modified in accordance with the invention for providing the improved nonlinear vane schedules, while the remaining stator vanes may be conventionally scheduled with the fixed mounted second levers 44 joined to the common actuation beam 42*b*. In this way, additional optimization of one or more variable stator vane rows may be accomplished relative to one or more of the adjacent variable stator vane rows that are conventionally scheduled in a substantially linear manner.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

1. An actuation system for variable stator vanes pivotally mounted in a casing of a gas turbine engine compressor comprising:

a plurality of levers each having a proximal end fixedly joined to respective ones of said vanes, and an opposite distal end, for pivoting said vane as said lever is rotated;

an actuation ring coaxially surrounding said casing adjacent said levers;

a plurality of circumferentially spaced apart ring guides joined to said casing for guiding circumferential rotation of said ring; and respective slip joints joining each of said lever distal ends to said ring for varying pivot length of said levers as said ring is rotated.

2. A system according to claim 1 wherein each of said slip joints comprises a pin engaging a slot disposed between said lever distal end and said ring for joining together said lever and ring to effect said variable pivot length as said ring rotates said lever.

3. A system according to claim 2 wherein: said pin is fixedly joined to said ring and extends radially; and said slot is disposed in said lever distal end to slidingly engage said pin.

4. A system according to claim 3 wherein:

each of said levers has a longitudinal axis extending between said proximal and distal ends with which a corresponding vane pivots as said lever is rotated; and each of said slots is disposed in said lever distal ends at least in part along said lever axis for allowing said pins to move in said slots along said lever axes.

5. A system according to claim 4 wherein said slots are aligned coaxially with respective ones of said lever axes.

6. A system according to claim 4 wherein said slots are skewed with respective ones of said lever axes.

7. A system according to claim 4 wherein said slots are straight.

8. A system according to claim 4 wherein said ring guides are joined to said casing on opposite axial sides of said ring to constrain axial movement thereof while permitting circumferential rotation thereof.

9. A system according to claim 4 further comprising means for rotating said ring to rotate said levers to pivot said vanes.

10. A system according to claim 9 wherein said rotating means comprise:

a beam extending axially along said casing, and having a proximal end pivotally joined to said casing;

a link extending circumferentially between said ring and beam, and pivotally joined thereto; and an actuator joined to a distal end of said beam to selectively rotate said beam to rotate said ring through said link.

11. An actuation system for variable stator vanes pivotally mounted in a casing of a gas turbine engine compressor, comprising:

a plurality of levers each having a proximal end fixedly joined to respective ones of said vanes, and an opposite distal end, for pivoting said vane as said lever is rotated;

an actuation ring coaxially surrounding said casing adjacent said levers;

a plurality of circumferentially spaced apart ring guides joined to said casing on opposite axial sides of said ring to restrain axial movement thereof while permitting circumferential rotation thereof; and respective slip joints joining each of said lever distal ends to said ring for varying pivot length of said levers as said ring is rotated.

12. A system according to claim 11 wherein:

each of said levers has a longitudinal axis extending between said proximal and distal ends, with which a corresponding vane pivots as said lever is rotated; and each of said slip joints is disposed at said lever distal ends at least in part along said lever axis for movement therealong.

13. A system according to claim 12 wherein each of said slip joints comprises a pin fixedly joined to said ring, and a corresponding slot disposed in said lever distal end slidingly receiving said pin to effect said variable pivot length as said ring rotates said lever.

14. A system according to claim 13 wherein said slots are aligned coaxially with respective ones of said lever axes.

15. A system according to claim 13 wherein said slots are skewed with respective ones of said lever axes.

16. An actuation system for variable stator vanes pivotally mounted in a casing of a gas turbine engine compressor, comprising:

a plurality of levers each having a proximal end fixedly joined to respective ones of said vanes, and an opposite distal end, for pivoting said vane as said lever is rotated;

an actuation ring coaxially surrounding said casing adjacent said levers; and means for joining each of said lever distal ends to said ring to vary pivotal length of said levers as said ring is rotated.

17. A system according to claim 16 further comprising means for restraining axial movement of said ring while permitting circumferential rotation thereof.

18. A system according to claim 17 wherein said joining means comprise respective slip joints between said levers and ring.

19. A system according to claim 18 wherein said ring restraining means are disposed on opposite axial sides of said ring.

* * * * *